US008191710B2

(12) United States Patent
Clarke

(10) Patent No.: US 8,191,710 B2
(45) Date of Patent: Jun. 5, 2012

(54) PACKAGING

(75) Inventor: Tim Clarke, Compton-Surrey (GB)

(73) Assignee: Duff Design Limited, London (GB)

( * ) Notice: Subject to any disclaimer, the term of this patent is extended or adjusted under 35 U.S.C. 154(b) by 0 days.

(21) Appl. No.: 12/528,883

(22) PCT Filed: Feb. 27, 2008

(86) PCT No.: PCT/GB2008/000653

§ 371 (c)(1),
(2), (4) Date: Aug. 27, 2009

(87) PCT Pub. No.: WO2008/104765

PCT Pub. Date: Sep. 4, 2008

(65) Prior Publication Data

US 2010/0101972 A1 Apr. 29, 2010

(30) Foreign Application Priority Data

Feb. 27, 2007 (GB) ..... 0703789.8

(51) Int. Cl.
*B65D 83/04* (2006.01)

(52) U.S. Cl. ..... 206/531; 206/532; 206/539; 206/464; 206/536

(58) Field of Classification Search ..... 206/531, 206/528, 538, 800, 461, 471, 536, 534.1, 206/1.5

See application file for complete search history.

(56) References Cited

U.S. PATENT DOCUMENTS

| | | | |
|---|---|---|---|
| 1,984,351 | A | 12/1934 | Johnson |
| 3,429,426 | A | 2/1969 | Wolf et al. |
| 5,310,060 | A | 5/1994 | Bitner et al. |
| 5,878,887 | A | 3/1999 | Parker et al. |
| 2003/0080021 | A1 | 5/2003 | Kopecky |

(Continued)

FOREIGN PATENT DOCUMENTS

| | | | |
|---|---|---|---|
| DE | 20 2005 014 196 | U1 | 2/2006 |

(Continued)

OTHER PUBLICATIONS

International Searching Authority "International Search Report" dated Jul. 2, 2008.

International Searching Authority "Written Opinion of the International Searching Authority" dated Jul. 2, 2008.

*Primary Examiner* — David T. Fidei
*Assistant Examiner* — Raven Collins
(74) *Attorney, Agent, or Firm* — Holland & Hart LLP

(57) ABSTRACT

A container (12) suitable for use in packaging pharmaceutical products such as tablets and capsules. The container (12) can be withdrawn from a box or sleeve (14) in a first direction X to a fully extended position whereby a user can remove any item stored by the container (12). The container (12) has a base (32) which includes an end portion (40) that remains substantially within the box or sleeve (14) when in the fully extended position. The base (32) carries at least one chamber formation (42) for containing an item to be removed by the user. The base (32) also has at least one stabilizing formation (44) on the end portion (40) that interacts with the box or sleeve (14) when in the fully extended position to resist pivoting of the container (12) relative to the box or sleeve (14). The or each stabilizing formation (44) differs in size and/or shape to the or each chamber formation (42), and has a length in the first direction X that is greater than or equal to its width in a second direction Y. The second direction Y is substantially orthogonal to the first direction X across the base (32).

36 Claims, 9 Drawing Sheets

U.S. PATENT DOCUMENTS

| | | | | |
|---|---|---|---|---|
| 2003/0196925 | A1 | 10/2003 | Dalessandro | |
| 2004/0050748 | A1 | 3/2004 | Ehrlund | |
| 2004/0140242 | A1 | 7/2004 | Davies | |
| 2005/0178692 | A1* | 8/2005 | Chang | 206/531 |
| 2007/0068843 | A1 | 3/2007 | Hession | |
| 2007/0272586 | A1* | 11/2007 | Hession | 206/532 |

FOREIGN PATENT DOCUMENTS

| | | | |
|---|---|---|---|
| EP | 1140639 | B1 | 5/2003 |
| GB | 2389355 | | 12/2003 |
| GB | 2451850 | | 2/2009 |
| WO | WO 91/07332 | | 5/1991 |
| WO | 98/24696 | | 6/1998 |
| WO | WO 99/01101 | | 1/1999 |
| WO | WO 00/38999 | | 7/2000 |
| WO | WO 03/076303 | | 9/2003 |
| WO | WO 2004/037657 | | 5/2004 |
| WO | WO 2005/030606 | | 4/2005 |
| WO | WO 2005/068304 | | 7/2005 |
| WO | WO 2006/057318 | | 6/2006 |
| WO | WO 2006/076705 | | 7/2006 |
| WO | WO 2007/129090 | | 11/2007 |
| WO | WO 2007/140328 | | 12/2007 |
| WO | WO 2008/027437 | | 3/2008 |
| WO | WO 2008/082527 | | 7/2008 |
| WO | WO 2008/113694 | | 9/2008 |
| WO | WO 2009/013471 | | 1/2009 |
| WO | WO 2009/013485 | | 1/2009 |
| WO | WO 2009/024772 | | 2/2009 |
| WO | WO 2009/092095 | | 7/2009 |

* cited by examiner (a)

(b)

(a)

(b)

(a)

(b)

PACKAGING

The present invention relates to packaging, such as a box. The invention may be used in the packaging of any item but is particularly suitable for the packaging of pharmaceutical products such as tablets, capsules or the like.

Tablets and capsules are often packaged in blister packs. A blister pack comprises a moulded plastic base having one or more formations each defining a blister chamber, typically for containing a tablet or capsule; these formations are commonly referred to as 'blisters'. The base is generally covered by a thin layer of foil for sealing the tablets or capsules within the blisters. Pressing on a blister causes the tablet or capsule contained in that blister to penetrate the foil layer so that it can easily be removed from the pack. The blister from which the tablet is removed is left deformed, and the foil is torn in the region below the blister, but the other blisters remain intact. Blister packs are usually packaged in a box together with a leaflet containing information about the medication.

Packaging is important when marketing a product as good packaging may result in increased sales of the product. Good packaging should hold items securely, but should also be easy and convenient to open by people of all levels of ability and dexterity. In addition to these functional attributes, good packaging should also have an attractive appearance and, preferably, intriguing characteristics.

Packages in which a blister pack is slidably housed within a box or sleeve are known. One problem with such packages is that when the blister pack is withdrawn from the box or sleeve to an extended position so that a user can access the items contained within the blisters, the blister pack tends to pivot or droop relative to the box or sleeve. This drooping compromises the quality of the package by impairing its visual appeal. The utility of the package is also compromised because a drooping blister pack can sometimes be difficult to reinsert into the box or sleeve. This problem is illustrated in FIG. 3(*a*) of the accompanying drawings.

A further problem with blister packs, or similar tab members that are housed within a sleeve, is that when there are two packs within the sleeve, it can be difficult to grasp the end of one pack, in order to withdraw that pack from the sleeve, without also grasping the other pack.

Packages which comprise belt-driven tab members are also known. For example, EP1140639 of the Applicant, the subject matter of which is incorporated into this specification by reference, describes a box comprising a generally tubular sleeve defining a through passage, a planar divider extending across said passage, a belt extending around said divider, and a tray member extending into said passage, characterised in that the box further comprises a tab member extending into said passage, and wherein each of said tray member and said tab member are attached to said belt, such that when said tab member is moved out of said passage in a first direction said tray member moves out of said passage in a second direction opposite to said first direction, and said belt is in the form of a continuous loop such that when said tab member is moved into said passage in said second direction said tray member moves into said passage in said first direction.

The box of EP1140639 is appealing to a user, who is surprised, upon first opening the box, that the tray moves automatically in the opposite direction when the tab member is pulled.

It is an object of the invention to provide improved packaging, which overcomes the aforesaid disadvantages associated with the prior art, and that in some embodiments is apt to be used with a belt drive means like that of EP1140639.

In one sense, the inventive concept may be expressed as a container suitable for withdrawal from a box or sleeve in a first direction to a fully extended position whereby a user can remove any item or items stored by the container, the container comprising a base having an end portion that remains substantially within the box or sleeve when in the fully extended position, wherein: the base carries at least one chamber formation for containing an item to be removed by the user, and at least one stabilising formation on the end portion that interacts with the box or sleeve when in the fully extended position to resist pivoting of the container relative to the box or sleeve; the or each stabilising formation differs in size and/or shape to the or each chamber formation; and the or each stabilising formation has a length in the first direction that is greater than or equal to its width in a second direction, the second direction being substantially orthogonal to the first direction across the base.

The container preferably takes the form of a blister pack with blisters defining the chamber formations. Items may be contained within the blisters, and the container is particularly suitable for carrying orally consumable items. The term 'orally-consumable' refers to items which are typically chewed or swallowed and may be in the form of tablets, capsules, pills, caplets or the like. Examples of such items include painkillers such as paracetamol and ibuprofen, or other medicaments for example antibiotics. The blister pack is also suitable for packaging vitamins and confectionery such as chewing gum.

The base of the container preferably carries a sealing layer for cooperating with the or each chamber formation to enclose an item therein. In addition to enclosing items within the chamber formations, the sealing layer may ensure that the items are kept fresh, and in some cases sterile, within the chamber formations. Preferably, the sealing layer is penetrable, for example by pushing the contents of the chamber through the layer, and may typically be made from foil or a similar material. Alternatively, a flexible layer of suitable material may be bonded to the base, which layer can be peeled back in order to remove items from the chamber formations.

Preferably, when the container is a blister pack, the stabilising formations take the form of empty blisters. The empty blisters do not contain items of the type contained within the remaining blisters. The empty blisters preferably remain substantially within the box or sleeve when the blister pack is in the fully extended position. In other embodiments of the invention, the stabilising formations could be solid.

The size and orientation of the stabilising formations on the end portion are chosen so that they interact with the sleeve to stabilise the container when fully extended from the sleeve. Preferably the stabilising formations are elongate and may be aligned such that a longitudinal axis of the or each stabilising formation is at an angle of up to substantially 45 degrees to the first direction. Preferably still, and for maximum stabilising effect, the stabilising formations are aligned substantially parallel to the first direction.

Preferably, the sealing layer overlies the stabilising formations, however in other embodiments, the sealing layer may stop short of the end portion of the container, and hence not extend to the or each stabilising formation. In general, when the sealing layer is intact, that is before any items have been removed from the container by penetrating the sealing layer or by the sealing layer being peeled back from the base of the container, the or each chamber formation contains an orally-consumable item therein and the or each stabilising formation does not.

The inventive concept therefore encompasses a container suitable for withdrawal from a box or sleeve in a first direction to a fully extended position whereby a user can remove any orally-consumable item or items stored by the container, the container comprising a base having an end portion that remains substantially within the box or sleeve when in the fully extended position, wherein: the base carries at least one chamber formation for containing an item to be removed by the user, and at least one stabilising formation on the end portion that interacts with the box or sleeve when in the fully extended position to resist pivoting of the container relative to the box or sleeve; the base carries a sealing layer that cooperates with the or each chamber formation to enclose an item therein; when the sealing layer is intact, the or each chamber formation contains an orally-consumable item therein and the or each stabilising formation does not; and the or each stabilising formation has a length in the first direction that is greater than or equal to its width in a second direction, the second direction being substantially orthogonal to the first direction across the base.

The inventive concept also encompasses a package comprising a box or sleeve and a container suitable for withdrawal from a first end of the box or sleeve in a first direction to a fully extended position whereby a user can remove any item or items stored by the container, wherein: the container comprises a base carrying one or more chamber formations for containing items to be removed by the user; the package is arranged such that an end portion of the base is retained substantially within the box or sleeve when in the fully extended position; the base has at least one stabilising formation on the end portion that interacts with the box or sleeve when in the fully extended position to resist pivoting of the container relative to the box or sleeve; and the or each stabilising formation has a length in the first direction that is greater than or equal to its width in a second direction, the second direction being substantially orthogonal to the first direction across the base.

Preferably, the majority of the or each stabilising formation remains within the sleeve when the container is in the fully extended position. Preferably still, to maximise the stabilising effect, the or each stabilising formation remains entirely within the sleeve when the container is in the fully extended position.

The package may be belt driven in substantially the same way as the package described in EP1140639. A belt-driven package further comprises a tab member and a belt, the belt extending between a first end and a second end of a belt path, wherein the tab member and the container are attached to the belt such that the container is driven by the belt to move out of the first end of the box or sleeve when the tab member is moved out of an opposed second end of the box or sleeve.

The tab member and the container may be attached to the belt by respective bonds, the movement of the tab members being delimited by at least one bond reaching an end of the belt path.

In one embodiment of the invention, the tab member may be substantially flat. In said embodiment, the container may be a blister pack and the substantially flat tab member may be printed with information concerning the items within the blister pack. In another embodiment, in addition to the container being a blister pack, the tab member may also be a blister pack.

The inventive concept extends to a package comprising: first and second tab members slidably housed within a box or sleeve having opposed first and second ends; a belt extending between a first end and a second end of a belt path; the first and second tab members being attached to the belt such that when the first tab member is withdrawn from the first end of the sleeve, the second tab member is driven by the belt to move out of the second end of the sleeve; and the tab members being attached to the belt by respective bonds, the movement of the tab members relative to the sleeve being delimited by at least one bond reaching an end of the belt path, wherein an end portion of the or each tab member is penetrated by an aperture into which a fingertip may be inserted, the aperture thereby assisting in the withdrawal of said tab member from a box or sleeve in which it is housed. The aperture facilitates the withdrawal of a tab member from the box or sleeve by the elderly or infirm who may not otherwise be capable of gripping the edge of a tab member.

As with the other embodiments described above, at least one of the tab members is preferably a blister pack. In order to facilitate a smooth withdrawal of a tab member from the box or sleeve, it is preferable that the aperture is substantially centrally located with respect to the width of the tab member transverse to the direction of said movement of the tab members.

Any of the tab members or containers described above may have a cut-out portion at an end. When multiple tab members are housed within a box or sleeve, the cut-out portions ensure that a user grips the correct tab member or container when attempting to grip and withdraw a tab member or container from a particular end of the sleeve.

The inventive concept therefore further extends to a container comprising a base carrying at least one chamber formation for containing an item to be removed by a user, the container having opposed ends at least one of which is interrupted by a cut-out portion, wherein the container is adapted to be housed within a box or sleeve opposed to an identical container in opposite orientation such that the cut-out portions of the respective containers are located at opposite ends of the box or sleeve, with the cut-out portion of each container providing finger-grip access to an end of the other container at the same end of the box or sleeve.

Preferably, the cut-out portion is located substantially centrally with respect to the width of the associated end of the container.

The container may be arranged with a similar container in a package, hence the inventive concept also encompasses a package comprising first and second containers slidably housed within a box or sleeve; the package being arranged such that the first container can be removed from a first end of the box or sleeve, and the second container can be removed from an opposed second end of the box or sleeve; the first and second containers each carrying one or more chamber formations for containing items to be removed by a user; each container having opposed first and second ends, and the second end of each container having a cut-out portion; the package having a closed position in which the first and second containers are both housed substantially within the sleeve, with the first container overlying the second container and the cut-out portions of the respective containers being located at opposite ends of the box or sleeve, wherein when the package is in the closed position, the cut-out portion of the first container defines a pull region at the first end of the second container, and the cut-out portion of the second container defines a pull region at the first end of the first container; the pull regions enabling a user to grasp the first container without grasping the second container and vice versa.

Whilst some of the optional features outlined above are, for brevity, only described with reference to a particular embodiment of the invention, it should be appreciated that these optional features are interchangeable with any of the other embodiments described or claimed herein.

In order that this invention may be more readily understood, currently preferred embodiments will now be further described by way of example with reference to the accompanying drawings, in which:

FIG. 1 is a perspective view of a package in which a blister pack is shown extending from an open end of a sleeve;

FIGS. 2(*a*), 2(*b*) and 2(*c*) show, respectively, a plan view, a side view and an end view of the blister pack of FIG. 1;

FIG. 3(*b*) is a side view of the package of FIGS. 1 and 2, showing how the blister pack does not droop when extended from the sleeve;

Figure 8:
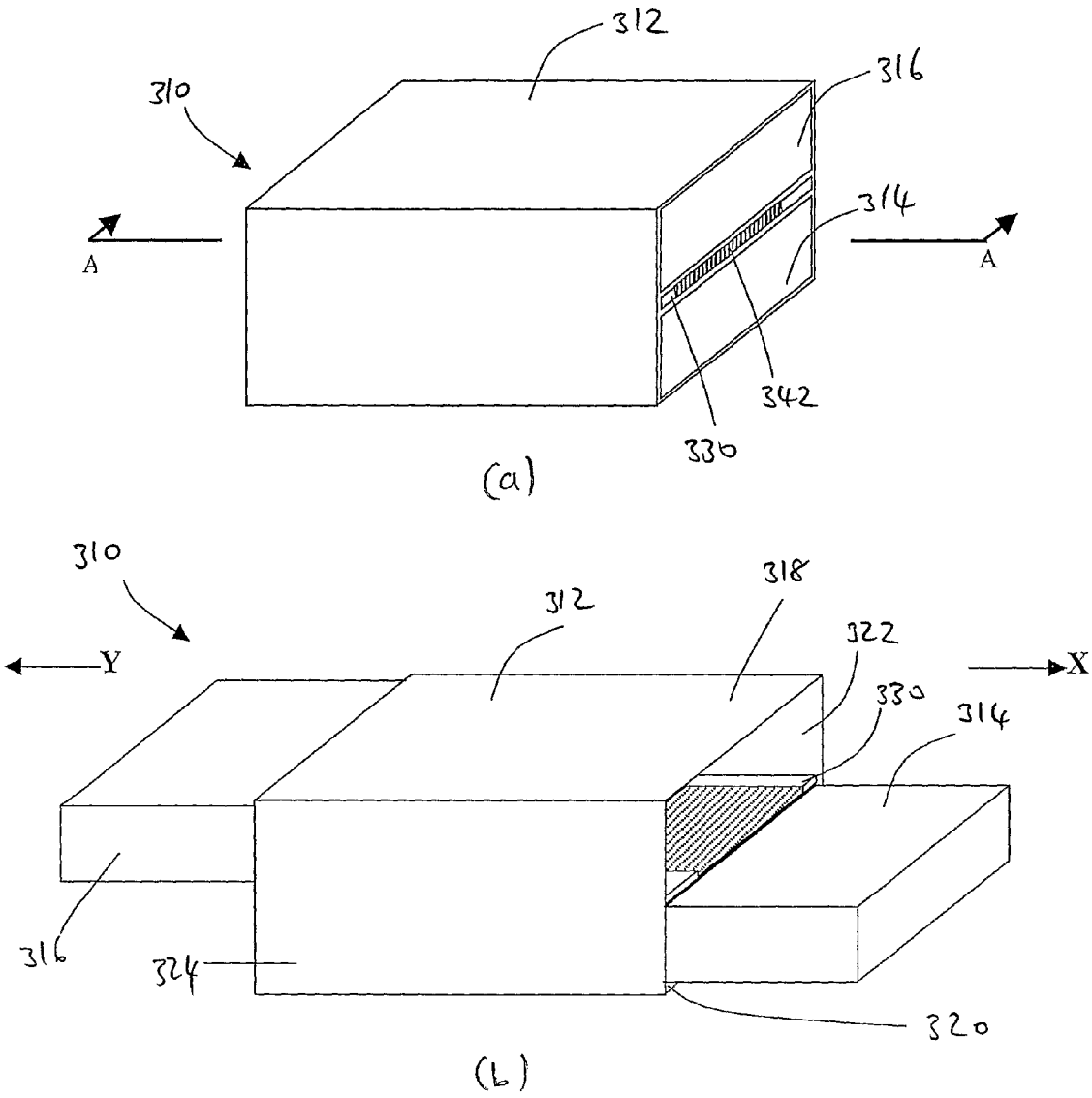
Figure 9:
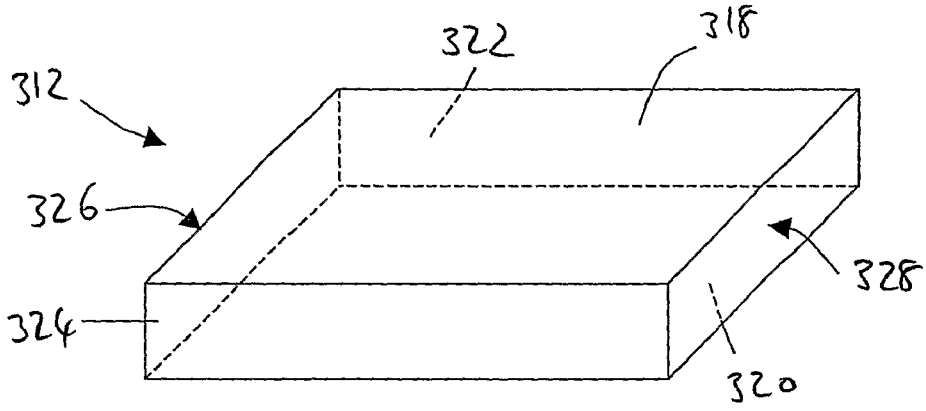
Figure 9:
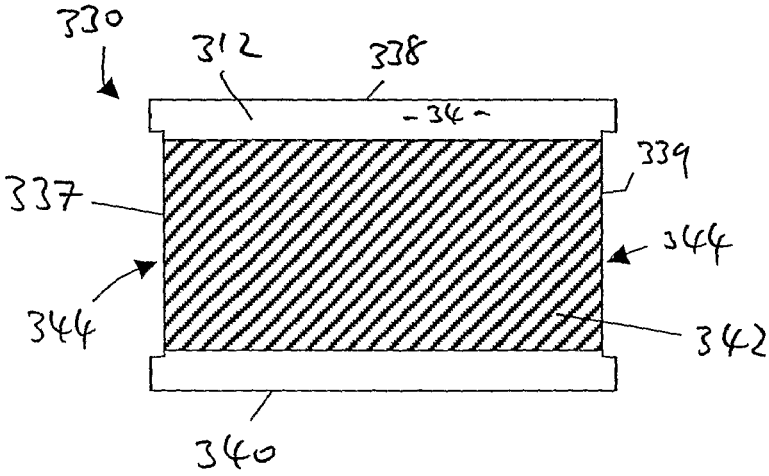
Figure 10:
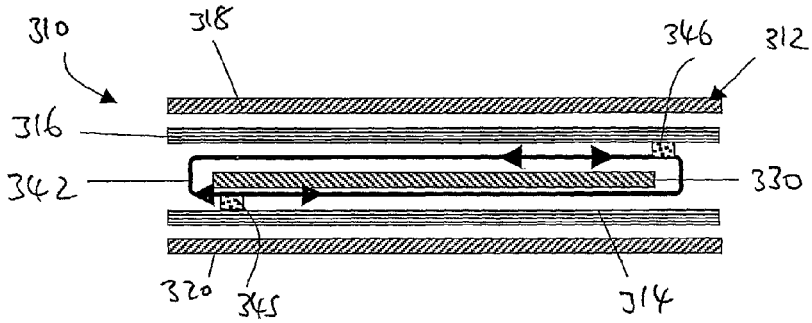
Figure 10:
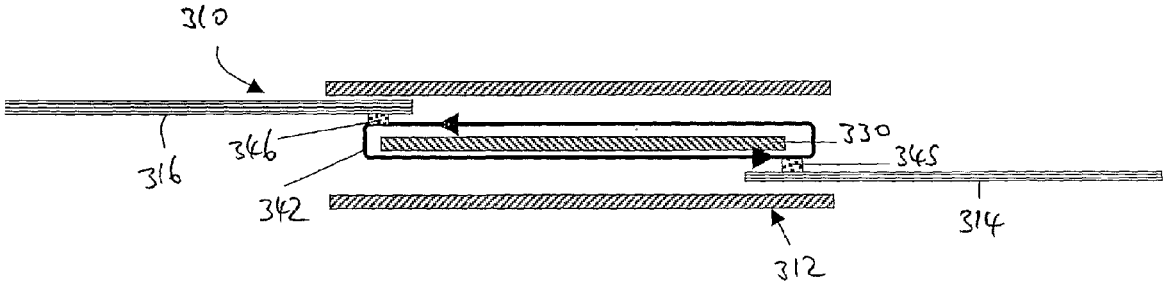
Figure 11:
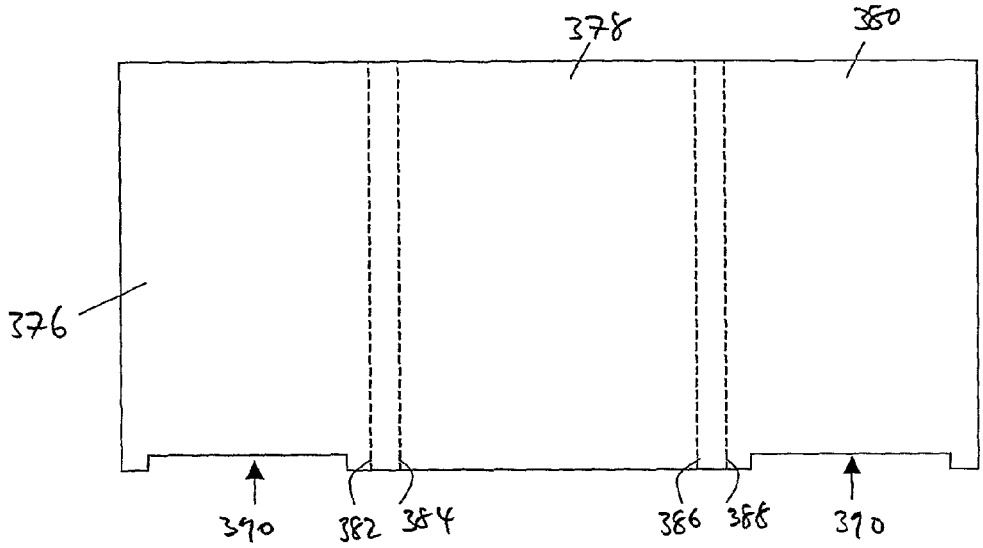
Figure 12:
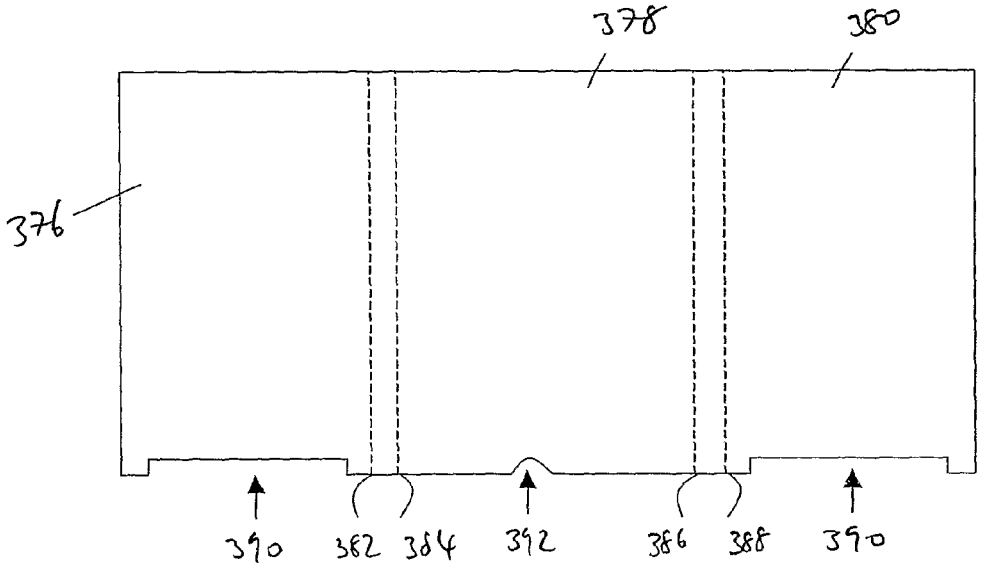

FIGS. 8(*a*) and 8(*b*) are perspective views of a box which comprises first and second tab members, a divider and a sleeve, when the tab members are (a) in a closed position, and (b) in an open position;

FIG. 9(*a*) is a perspective view of the sleeve of the box of FIG. 8;

FIG. 9(*b*) is a plan view of an upper face of the divider of the box of FIG. 8;

FIGS. 10(*a*) and 10(*b*) are cross-sections on line A-A of the box of FIG. 8(*a*), when the tab members are (a) in a closed position, and (b) in an open position;

FIG. 11 is a plan view of a blank of the sleeve forming part of the box of FIG. 8; and FIG. 12 is a plan view of a blank of an alternative sleeve for forming part of the box of FIG. 8.

Figure 1:
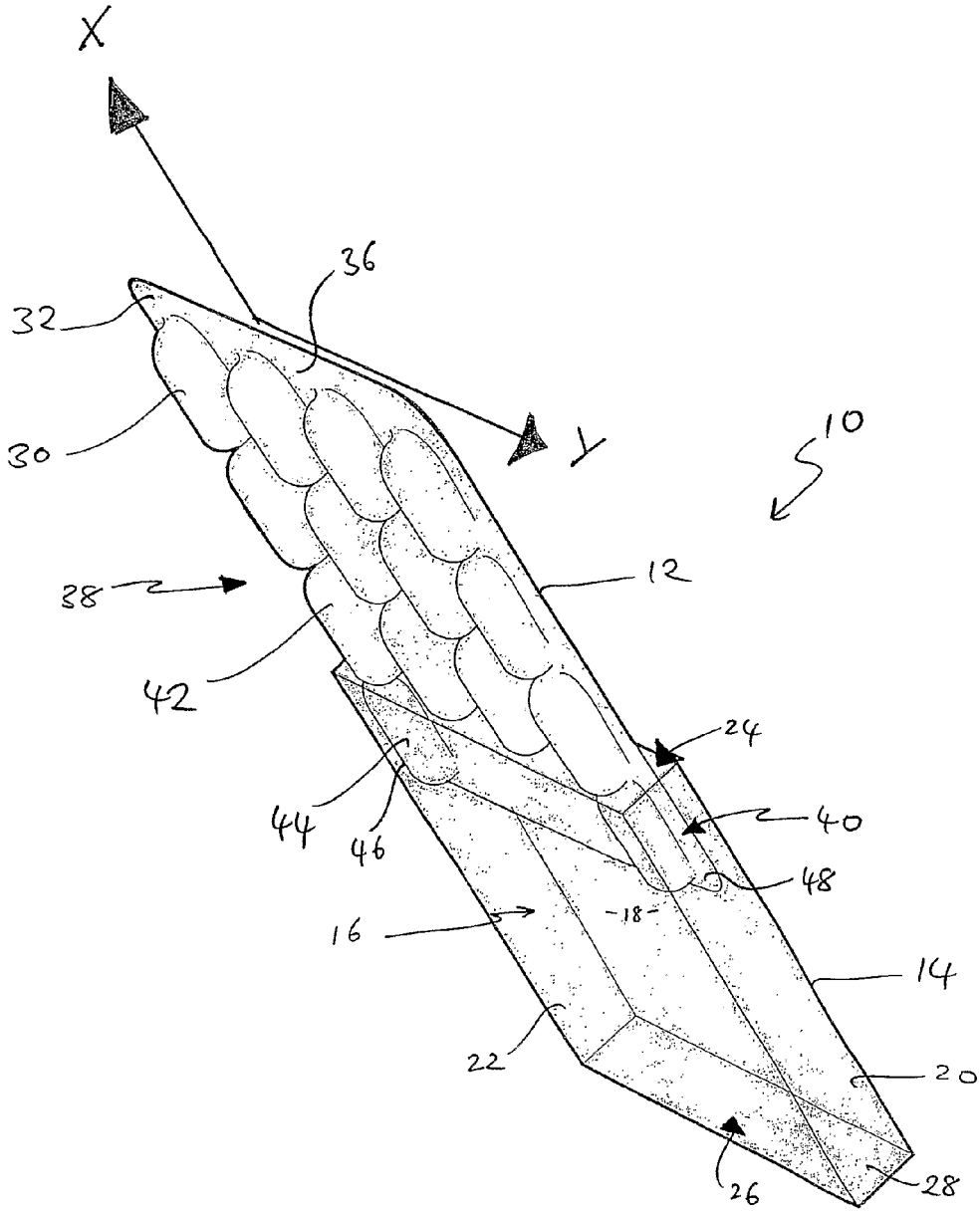

FIG. 1 is a perspective view of a package 10 comprising a container 12 in the form of a blister pack, which is slidably housed within a sleeve 14. The sleeve 14 is oblong and comprises opposing main faces 16, 18 and opposing side walls 20, 22. The sleeve 14 is open at a first end 24, and closed at a second end 26 by an end wall 28. The blister pack 12 comprises a plurality of blisters 30, each protruding from a planar oblong base 32, and each defining a blister chamber suitable for containing a tablet, capsule or similar such item (not shown). A layer of foil 34 is provided on the reverse side 35 of the base 32 for sealing the tablets within the blister pack 12; the foil layer 34 is not visible in FIG. 1, but can be seen in FIG. 4, in which the reverse side 35 of a blister pack is visible.

The blister pack 12 has a first end 36 at which a user may grasp the base 32 between finger and thumb to withdraw the blister pack 12 from the open first end 24 of the sleeve 14, towards a fully extended position as illustrated in FIG. 1.

In the fully extended position shown in FIG. 1, a major portion 38 of the blister pack 12 extends from the open first end 24 of the sleeve 14, and a minor portion 40 of the blister pack 12 is retained substantially within the sleeve 14. The major portion 38 includes a set of first blisters 42, each of which contains a tablet (not shown). In this example, there are twelve first blisters 42 arranged in three rows of four. The first blisters 42 are elongate and aligned parallel to a direction of withdrawal of the blister pack 12 from the sleeve 14 as represented by the arrow X in FIG. 1. As such, the first blisters 42 are longer in the direction of withdrawal X, than in an orthogonal direction across the base 32, as indicated by arrow Y in FIG. 1.

The minor portion 40 of the blister pack 12 includes a set of second blisters 44. The second blisters 44 do not contain a tablet or capsule and so remain empty. The second blisters 44 are provided to support the blister pack 12 when fully extended from the sleeve 14 as shown in FIG. 1, and as will be described in more detail later. In this example, there are two second blisters 44 which are spaced apart from each other towards the corners 46, 48 of the base 32 in the minor portion 40 of the blister pack 12. The second blisters 44 are both elongate and aligned with the first blisters 42. When oriented in this way, the second blisters 44 are substantially parallel to the direction of withdrawal of the blister pack 12 from the sleeve 14 as represented by arrow X.

Figure 2:
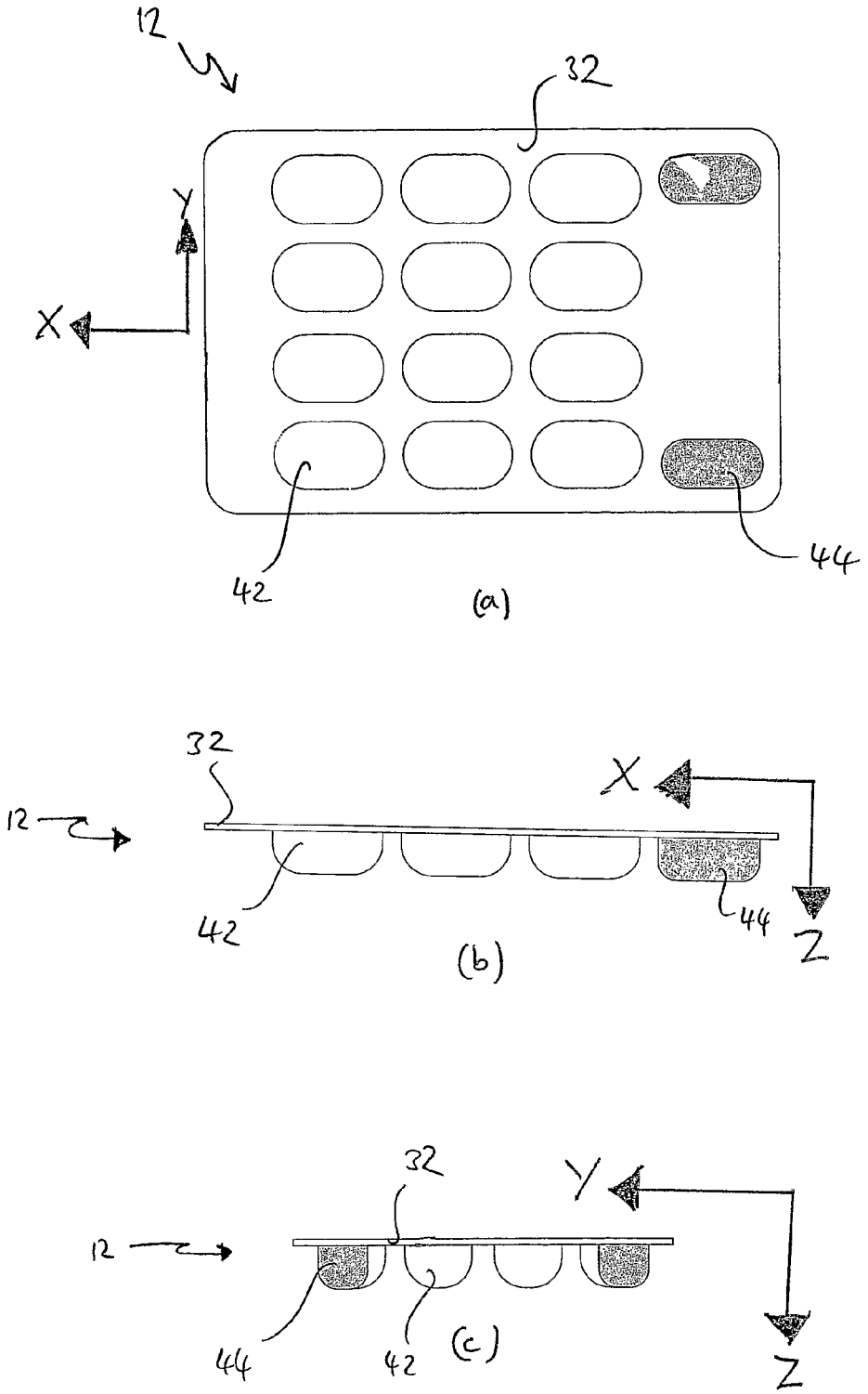

FIGS. 2(*a*), 2(*b*) and 2(*c*) show, respectively, a plan view, a side view and an end view of the blister pack 12 of FIG. 1. From these views, it can be seen that, in this example, the dimensions of the first and second blisters 42, 44 are different to one another. As best seen in FIGS. 2(*a*) and 2(*c*), the first and second blisters 42, 44 have substantially the same length parallel to arrow X. However as best seen in FIG. 2(*b*), the second blisters 44 are narrower than the first blisters 42 in the direction of arrow Y. As shown in FIG. 2(*c*), the first and second blisters 42, 44 protrude from the base 32, in the direction of arrow Z, to substantially equal extents. It should be understood that in other embodiments of the invention, the first and second blisters 42, 44 may have any other suitable dimensions. For example the second blisters 44 may be longer, shorter or wider than the first blisters 42, and/or the second blisters 44 may protrude from the base 32 to a greater or lesser extent than the first blisters 42.

Figure 3:
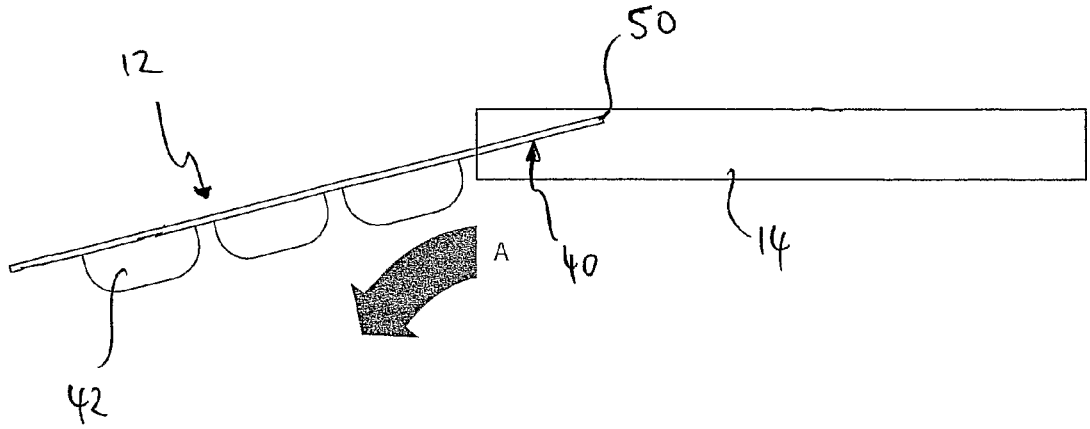
FIG. 3(*a*) is a side view of a package in which a blister pack droops when extended from a sleeve.
Figure 3:
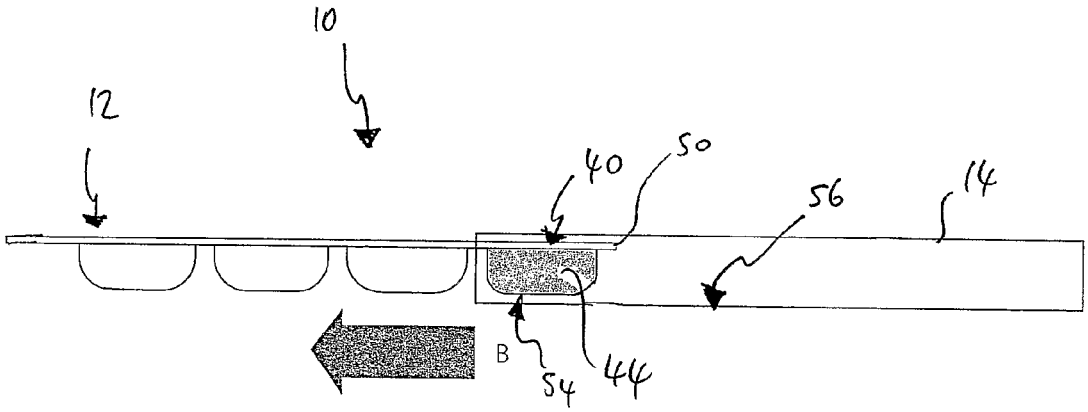

FIG. 3(*a*) is a side view of a prior art package in which similar parts are referenced with the same reference numerals as in FIGS. 1 and 2. The minor portion 40 of the blister pack 12 in FIG. 3(*a*) does not include any second blisters. As shown in FIG. 3(*a*), when the blister pack 12 is fully extended, it pivots about a second end 50, and droops relative to the sleeve 14 in the direction of arrow A; this is primarily due to the weight of the tablets in the first blisters 42. Consequently, the sense of quality of the package is undermined. Furthermore, the utility of the package is compromised because the blister pack 12 may not slide out of the sleeve 14 easily, and because a drooping blister pack 12 can be difficult to reinsert into the sleeve 14.

FIG. 3(*b*) is a side view of the package 10 of FIG. 1, that is in which the minor portion 40 of the blister pack 12 includes the empty second blisters 44. A lower surface 54 of the second blisters 44 bears against an inner surface 56 of the sleeve 14 substantially to prevent the blister pack 12 from pivoting about the second end 50 relative to the sleeve 14. In this way, the second blisters 44 substantially prevent the blister pack 12 from drooping when in the fully extended position. As a result, the blister pack 12 slides out of the sleeve 14 with ease, and does not droop when fully extended. The blister pack 12 is easy to reinsert and the package 10 feels of high quality.

The package includes suitable retaining means for substantially preventing the blister pack 12 from being moved beyond the fully extended position. The retaining means are arranged such that when the blister pack 12 is withdrawn from the sleeve 14 to its maximum extent, the empty second blisters 44 remain substantially within the sleeve 14. The retaining means may comprise engaging portions on the blister pack 12 and on the sleeve 14; however in other embodiments of the invention, the blister pack 12 may be attached to a belt for driving the movement of the blister pack 12 and for limiting the extent to which the blister pack 12 can be moved out of the sleeve 14. The principle of belt-driving the blister pack 12 is described in detail later with reference to FIGS. 8 to 12.

Figure 4:
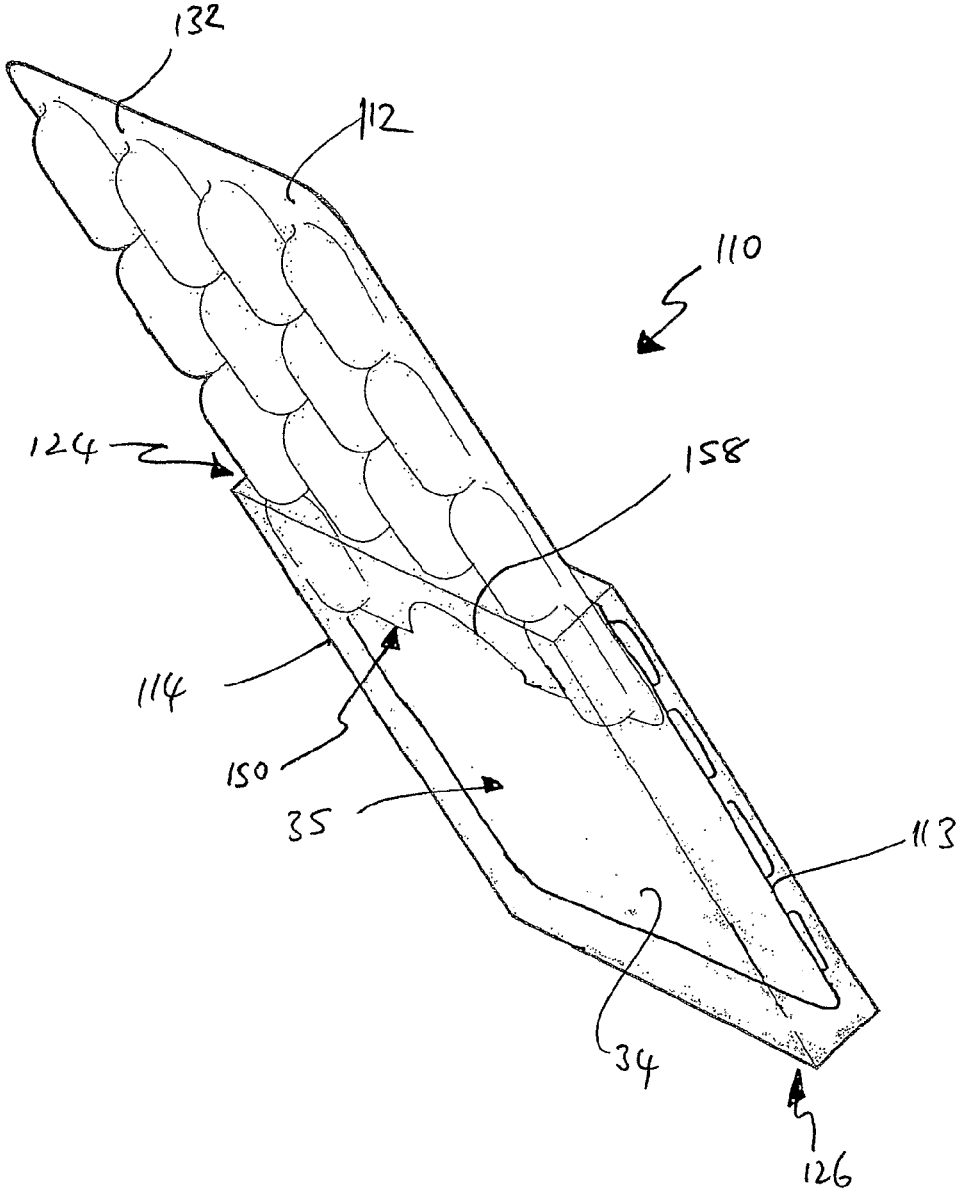
FIG. 4 is a perspective view of a package comprising first and second blister packs, in which the first blister pack is shown extending from an open end of a sleeve.

FIG. 4 is a perspective view of a package 110 according to a second embodiment of the invention in which features similar to those in FIGS. 1 to 3 have reference numerals increased by 100. The package 110 comprises first and second blister packs 112, 113 slidably housed within a sleeve 114. The first and second blister packs 112, 113 are each similar to the blister pack 12 described above with reference to the first embodiment; however in this example, the blister packs 112, 113 both have a cut-out portion 158, 160 in their base 132 at the second end 150 of the blister pack 112, 113. The cut-out portion 160 of the second blister pack 113 is not visible in FIG. 4 because it is obscured by the first blister pack 112. The first and second blister packs 112, 113 are arranged in the sleeve 114 with their foil layers 34 facing one another. The sleeve 114 has opposed first and second open ends 124, 126 and may be slightly larger than the sleeve 14 of the first embodiment in order to accommodate both blister packs 112, 113.

Figure 5:
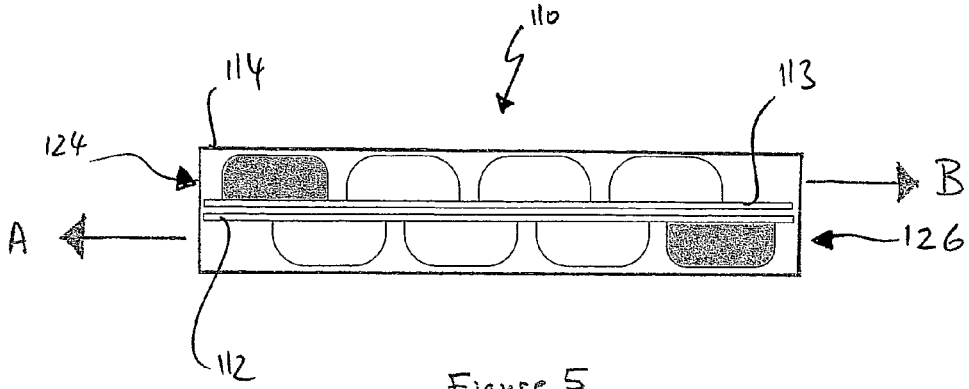
FIG. 5 is a side view of the package of FIG. 4, showing the first and second blister packs in a closed position in which they are each housed substantially within the sleeve.

Referring now to FIG. 5, this is a side view of the package of FIG. 4, in which the first and second blister packs 112, 113 are shown in a closed position, that is when they are both housed substantially within the sleeve 114. In this closed position, the first blister pack 112 overlies the second blister pack, and the cut-out portions 158, 160 of the first and second blister packs 112, 113 are at opposite ends 124, 126 of the sleeve 114. The first blister pack 112 is arranged to be withdrawn from the first end 124 of the sleeve 114 in the direction of arrow A, and the second blister pack 113 is arranged to be withdrawn from the second end 126 of the sleeve 114 in the direction of arrow B.

Figure 6:
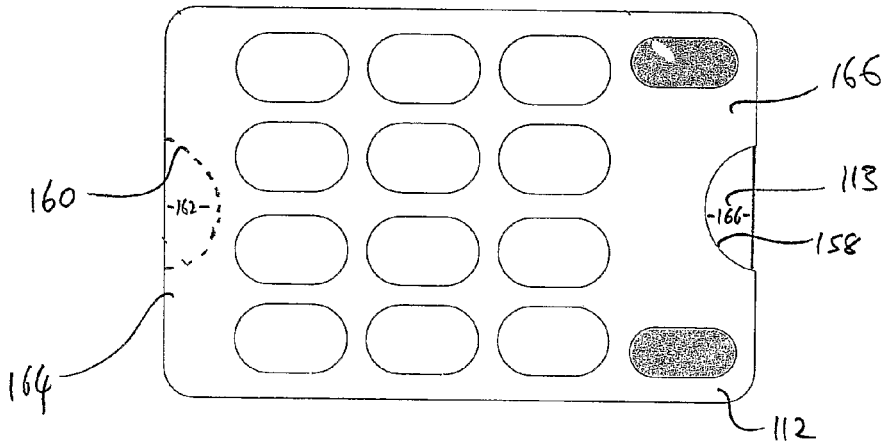
FIG. 6 is a plan view of the package of FIGS. 4 and 5 showing the first blister pack overlying the second blister pack when the blister packs are in closed positions, and in which the sleeve has been omitted for clarity.

FIG. 6 is a plan view showing the first blister pack 112 overlying the second blister pack 113 when the blister packs 112, 113 are in closed positions as shown in FIG. 5, however, for clarity, the sleeve 114 is not shown in FIG. 6. When the blister packs 112, 113 are in closed positions, the cut-out portion 160 of the second blister pack 113 (shown by the dashed line in FIG. 6) defines a pull region 162 of the first blister pack 112 at one end 164 of the package 110, and the cut-out portion 158 of the first blister pack 112 defines a pull region 166 of the second blister pack 113 at the other end 166 of the package 110.

In use, the cut-out portion 160 of the second blister pack 113 enables a user easily to grasp the pull region 162 of the first blister pack 112, without also grasping the second blister pack 113, when attempting to withdraw the first blister pack 112 from the first end 124 of the sleeve 114. Similarly the cut-out portion 158 of the first blister pack 112 enables the user easily to grasp the pull region 166 of the second blister pack 113, without also grasping the first blister pack 112, when attempting to withdraw the second blister pack 113 from the second end 126 of the sleeve 114. The sleeve 114 may have similar cut-outs aligned with the cut-outs 158, 160 of the blister packs 112, 113 to facilitate further the accessibility of the blister packs 112, 113 when in closed positions.

Figure 7:
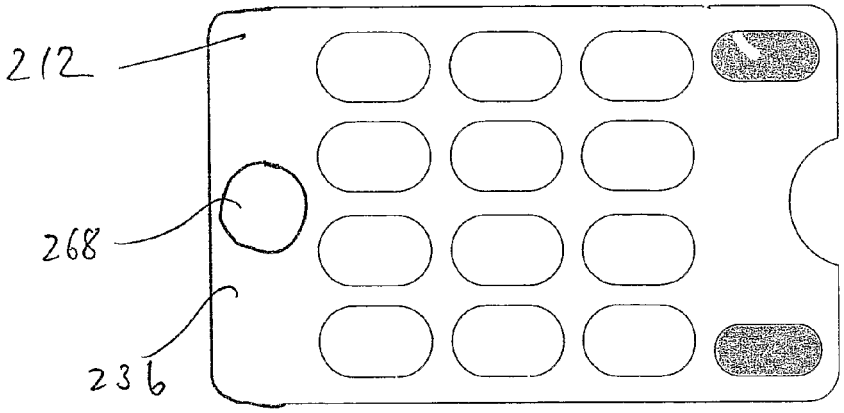
FIG. 7 shows a further blister pack which is suitable for use in either of the packages of FIGS. 1 and 4, and which includes an aperture at one end.

FIG. 7 shows another design of blister pack 212 which may be used in either of the packages 10, 110 of FIG. 1 or 4. The blister pack 212 is similar to the blister packs 12, 112, described above with reference to FIGS. 1 to 6, however the first end 236 of the blister pack 212 in FIG. 7 additionally defines an aperture 268, namely a hole penetrating the base 232. In use, a user can insert a fingertip into the aperture 268 when withdrawing the blister pack 212 from a sleeve 14, 114. The aperture 268 facilitates opening of the package 10, 110 by the elderly or infirm.

All of the packages 10, 110 described above may be adapted so that the or each blister pack 12, 112, 113 can be belt-driven. In such belt-driven packages, the or each blister pack 12, 112, 113 is attached to a belt located within the sleeve 14, 114, such that pulling a blister pack 12, 112, 113 or a tab member out of one end of the sleeve 14, 114 causes a blister pack 12, 112, 113 to move out of the other end of the sleeve 14, 114. The principle of belt-driving tab members is described in detail in EP1140639 of the Applicant, the content of which is incorporated herein by reference as aforesaid. For ease of reference, however, the main principles of operation of a belt-driven package will now be explained with reference to FIGS. 8 to 12.

Referring initially to FIGS. 8 and 9, there is shown a box 310 suitable for packaging and/or for display purposes. The box 310 includes a hollow rectangular body or sleeve 312 defining a through passage for housing a first tab member 314 and a second tab member 316. As can best be seen in FIG. 9(*a*), the sleeve 312 has an upper wall 318, a lower wall 320, two side walls 322, 324 and two open ends 326, 328. The box 310 also includes a planar divider 330 extending across the passage, between the open ends 326, 328 of the sleeve 312, and dividing the passage into upper and lower passages. The tab members 314, 316 extend the length of the through passage and are dimensioned so that they can be accommodated wholly within the sleeve 312. The first tab member 314 is housed in the lower passage, and the second tab member 316 is housed in the upper passage. The tab members 314, 316 are movable back and forth, relative to the divider 330 and the sleeve 312, towards and away from one another.

As can be most clearly seen in FIG. 9(*b*), the divider 330 has upper and lower faces 334, 336, two side edges 338, 340 and two ends 337, 339, and is substantially rectangular. The divider 330 has a band or belt 342, narrower than the divider 330, which extends around the divider 330 on a belt path (shown only in FIG. 9(*b*)) defined by the divider 330. The ends of the belt 342 are joined to form a continuous loop. The belt path is defined by a waist across the two ends 337, 339 defined by cut-out portions 344 at each end 337, 339 of the divider 330 which serves to restrain the belt 342 against lateral movement with respect to the divider 330. The divider 330 is attached or bonded to the sleeve 312 by means of adhesive (not shown) located adjacent to the side edges 338, 340 of the divider 330, or in any other convenient position. Alternatively, the divider 330 and the sleeve 312 may be integral.

The belt 342 is typically a strip of a low-friction sheet material such as plastics film, e.g. Cellophane™ or Treofan GND™, or a material with a low-friction coating such as PTFE. The belt material is selected so that the belt 342 can slide easily about the divider 330.

The tab members 314, 316 are attached to the belt 342 by bonds 345, 346, respectively, which are strips of adhesive. It will be appreciated that one of the tab members 314 or 316 could be a blister pack, whilst the other tab member 314 or 316 could be substantially flat and printed with information about the contents of the blister pack. A flat tab member may contain a pocket for storing an information leaflet or an information leaflet could be attached to such a flat tab member. In other embodiments, both of the tab members 314, 316 could be blister packs.

When the first tab member 314 is pushed or pulled in the direction of arrow X from the fully closed position (as shown in FIG. 8(*a*)), the first tab member 314 causes the belt 342 to turn about the divider 330 so that the second tab member 316 moves in the direction of arrow Y, away from the first tab member 314 (FIG. 8(*b*)). When the first tab member 314 is then pushed or pulled in the opposite direction (in the direction of arrow Y) back into the sleeve 312, the belt 342 is again caused to turn about the divider 330 in the opposite direction so that the second tab member 316 moves in the direction of arrow X, until both members are back in the fully closed position.

When in the fully closed position, the starting positions of the bonds 345, 346 are on either side of the length of the divider 330 and the lengths of the tab members 314, 316. This means that the first tab member 314 can be pulled/pushed in the X direction from the fully closed position, and the second tab member 316 can be pulled/pushed in the Y direction from the fully closed position, to the fully open position shown in FIG. 8(*b*). In the fully open position shown in FIG. 8(*b*), the first and second tab members 314, 316 are extended fully out of the sleeve 312 in the X and Y directions respectively. The first and second tab members 314, 316 are in a fully open or extended position when the bonds 345, 346 reach the end of the belt path at the end of the divider 330.

A more detailed illustration of the relative movement between the tab members 314, 316 and the divider 330 can be seen in FIG. 10. When a user pulls/pushes the first tab member 314 in the direction of arrow X, the first tab member 314 causes the belt 342 to translate relative to the divider 330. The passage of the belt 342 causes the second tab member 316 to move in the direction of arrow Y. When the bonds 345, 346 reach the ends of the divider 330, as shown in FIG. 10(*b*), the first tab member 314 can be pulled/pushed no further in the direction of arrow X, and the second tab member 316 is then in one of the fully open positions (FIG. 10(*b*)). In other words, when the first tab member 314 is pulled out of the sleeve 312, translation of the belt 342 around the divider stops when the bond 345 reaches the end of the belt path at the end of the divider 330.

When the user pushes the tab member 314 in the direction of arrow Y, the tab member 314 causes the belt 342 to translate in the opposite sense, so that the second tab member 316 moves in the direction of arrow X. The first tab member 314 can be pushed no further in the direction of arrow Y when the bonds 345, 346 reach their starting position (at the ends of the divider 330), as shown in FIG. 10(*a*). In other words, when the first tab member 314 is pushed back into the sleeve 312, translation of the belt 342 stops when the bond 345 reaches the end of the belt path at the end of the divider 330. If required the user can push the second tab member 316 in the direction of arrow Y to the fully closed position. The effect is the same, in that both the first and second tab members 314, 316 will return to the fully closed position.

The distance between opposite ends of the belt path of the divider 330 defines the maximum movement of each of the first and second tab members 314, 316. The movement of the first and second tab members 314, 316 with respect to the lower and upper faces 336, 334 of the divider 330 is delimited by the bonds 345, 346 reaching the end of the belt path at either end of the divider 330. The length of the belt path must therefore be chosen such that the travel of the tab members 314, 316 is sufficient to give access to the contents of the tab members 314, 316 when in the fully open positions.

It is possible to vary the belt drive so that the first and second tab members 314, 316 can both be moved out of both ends of the sleeve 312. This is achieved by locating the bonds 345, 346 inwards from the ends of the belt path when the tab members 314, 315 are in closed positions. Such an arrangement could be suitable for blister packs which have empty second blisters 44 at both ends. Furthermore, if the bonds 345, 346 are offset from one another when the tab members 314, 315 are in closed positions, then the package has an asymmetric opening characteristic whereby the tab members 314, 316 can be moved out of the first end of the sleeve to a first maximum extent, and out of the second end of the sleeve to a second maximum extent; the first and second maximum extents being different to one another.

The sleeve 312 can be made by folding and gluing a single flat blank manufactured by cutting and creasing from a sheet material such as plastic, cardboard or folding box board, as can be seen in FIG. 11. The blank comprises three panels 376, 378, 380 and is scored along four lines 382, 384, 386, 388. The panel 376 is folded over and is attached to the underside of panel 380 to form the lower wall of the sleeve. The portions between score lines 382 and 384, and 386 and 388 form the side walls 322, 324 of the sleeve 312.

By virtue of corresponding cut-outs at an end of each of the panels 376, 380, the lower wall of the sleeve 312 has an oblong cut-out 390 portion at one end. This cut-out 390 enables the user of the box 310 to hold an end portion of one of the first or second tab members 314, 316 by grasping it on both sides and pulling the tab member in the direction of arrow X. It will be appreciated that other shapes are also possible. In another embodiment of the present invention, shown in FIG. 12, the upper wall 318 of the sleeve 312 has a semi-circular cut-out 392 at the same end as the cut-out 390. This further eases grasping of a tab member 314, 316.

The sleeve can have a finish applied by foil blocking and embossing. The box/packaging could be provided with a wipe-clean finish by printing a varnish onto the print surface or by film laminating. Preferably, there is no forcible locking device on the packaging, so that the product can be loaded or unloaded easily, making the package suitable for the elderly and infirm.

Applying the above principles of belt driving tab members, the package of FIG. 1 may be adapted so that it additionally comprises a planar divider and a belt located within the sleeve. The blister pack would be attached to the belt on one side of the divider, and the package would further comprise a flat tab member attached to the belt on the other side of the divider. The closed end of the sleeve would be removed such that withdrawing the tab member from one end of the sleeve causes the blister pack to move automatically through the opposite end of the sleeve.

The package of FIG. 4 may similarly be adapted by the provision of a planar divider and belt. The first and second blister packs would then be attached to the belt on opposite sides of the divider such that movement of the first blister pack drives the movement of the second blister pack and vice versa.

It should be understood that many variations in the design of the blister packs are possible within the ambit of the invention. For example, the blister packs may have any number of first and/or second blisters. Further, the first and second blisters do not necessarily need to be elongate and may instead be circular or any other suitable shape. The first and second blisters may, additionally, be orientated at different angles to those shown in the drawings. However, it is advantageous if the length of the second blisters in the withdrawal direction is at least equal to, or preferably greater than the width of the second blisters in a transverse direction extending orthogonally to the withdrawal direction across the base of the blister pack. This maximises the stabilising effect of the second blisters 44.

Whilst the embodiments illustrated in FIGS. 4 to 6 comprise empty second blister chambers, it will be appreciated that the principle of having cut-outs at opposite ends of blister packs for facilitating opening is of general application and is therefore not limited to use with blister packs which incorporate such empty second blisters. Similarly, whilst the blister pack in FIG. 7 also comprises empty second blisters and a cut-out portion at one end, it should be appreciated that the advantages associated with the aperture equally apply to blister packs which do not have empty blisters and/or cut-outs. However, there may be advantages in combinations of features, such as the combination of a cut-out giving access to a blister pack that has an aperture partially aligned with the cut-out for ease of gripping. It is also advantageous for space efficiency that where a cut-out is provided, the cut-out lies between opposed second blisters or other stabilising formations at that end of the blister pack.

What is claimed is:

1. A package comprising first and second containers slidably housed within a box or sleeve;

the package being arranged such that the first container can be removed from a first end of the box or sleeve, and the second container can be removed from an opposed second end of the box or sleeve;

the first and second containers each carrying one or more chamber formations for containing items to be removed by a user;

each container having opposed first and second ends, and the second end of each container having a cut-out portion, the cut-out lying between opposed blisters or other stabilising formations at that end of the container;

the package having a closed position in which the first and second containers are both housed substantially within the sleeve, with the first container overlying the second container and the cut-out portions of the respective containers being located at opposite ends of the box or sleeve, wherein when the package is in the closed position, the cut-out portion of the first container defines a pull region at the first end of the second container, and the cut-out portion of the second container defines a pull region at the first end of the first container;

the pull regions enabling a user to grasp the first container without grasping the second container and vice versa.

2. The package of claim 1, wherein the cut-out of each container is located substantially centrally with respect to the width of the associated end of its container, the stabilising formations of its container comprising first and second supporting blisters spaced apart from each other towards corners of that end.

3. The package of claim 1, wherein the size and orientation of the stabilising formations of each container is chosen so that they interact with the box or sleeve to stabilise the container when fully extended from the sleeve in a position in which a major portion of the container extends from the box or sleeve, and a minor portion of the container is retained substantially within the box or sleeve.

4. The package of claim 1, wherein each stabilising formation of the containers differs in size and/or shape to the or each chamber formation of its associated container; and each stabilising formation has a length in the first direction that is greater than or equal to its width in a second direction, the first direction corresponding to a direction of withdrawal of the associated container from the box or sleeve, and the second direction being substantially orthogonal to the first direction across the base.

5. The package of claim 1, wherein each container takes the form of a blister pack with blisters defining the chamber formations.

6. The package of claim 3, wherein the majority of each supporting blister remains within the box or sleeve when the associated container is in the fully extended position.

7. The package of claim 1, wherein the containers are belt-driven.

8. The package of claim 1 wherein the containers are attached to a belt of the box or sleeve such that pulling one container out of one end of the box or sleeve causes the other container to move out of the other end of the box or sleeve.

9. The package of claim 1 wherein at least one container comprises an aperture for the insertion of a fingertip of a user.

10. A package comprising first and second containers slidably housed within a box or sleeve;

the package being arranged such that the first container can be removed from a first end of the box or sleeve, and the second container can be removed from an opposed second end of the box or sleeve;

the first and second containers each carrying one or more chamber formations for containing items to be removed by a user;

each container having opposed first and second ends, and the second end of each container having a cut-out portion located substantially centrally with respect to the width of the end, and first and second supporting blisters spaced apart from each other towards corners of the end, the size and orientation of the supporting blisters being chosen so that they interact with the box or sleeve to stabilise the container when fully extended from the sleeve in a position in which a major portion of the container extends from the box or sleeve, and a minor portion of the container is retained substantially within the box or sleeve;

the package having a closed position in which the first and second containers are both housed substantially within the sleeve, with the first container overlying the second container and the cut-out portions of the respective containers being located at opposite ends of the box or sleeve, wherein when the package is in the closed position, the cut-out portion of the first container defines a pull region at the first end of the second container, and the cut-out portion of the second container defines a pull region at the first end of the first container;

the pull regions enabling a user to grasp the first container without grasping the second container and vice versa.

11. A package comprising a container and a tab member slidably housed within a box or sleeve;

the package being arranged such that the container can be removed from a first end of the box or sleeve, and the tab member can be removed from an opposed second end of the box or sleeve;

the container carrying one or more chamber formations for containing items to be removed by a user;

the container having opposed first and second ends, and the second end of the container having a cut-out portion, the cut-out lying between opposed blisters or other stabilising formations at that end of the container;

the package having a closed position in which the container and tab member are both housed substantially within the sleeve, with the container overlying the tab member; wherein, when the package is in the closed position, the cut-out portion of the container defines a pull region of the tab member, the pull region enabling a user to grasp the tab member without grasping the container.

12. The package of claim 11 wherein the tab member is a second container carrying one or more chamber formations for containing items to be removed by a user.

13. The package of claim 11 wherein the tab member is substantially flat.

14. The package of claim 13 wherein the tab member is printed with information concerning the items within the container.

15. The package of claim 11 wherein an information leaflet is attached to the tab member.

16. The package of claim 11, wherein the cut-out of the container is located substantially centrally with respect to the width of the associated end of the container, with stabilising formations of its container comprising first and second supporting blisters spaced apart from each other towards corners of that end.

17. The package of claim 11, wherein the size and orientation of the stabilising formations of the container is chosen so that they interact with the box or sleeve to stabilise the container when fully extended from the sleeve in a position in which a major portion of the container extends from the box or sleeve, and a minor portion of the container is retained substantially within the box or sleeve.

18. The package of claim 11, wherein each stabilising formation of the container differs in size and/or shape to each chamber formation of the container; and each stabilising formation has a length in the first direction that is greater than or equal to its width in a second direction, the first direction corresponding to a direction of withdrawal of the associated container from the box or sleeve, and the second direction being substantially orthogonal to the first direction across the base.

19. The package of claim 11, wherein the container takes the form of a blister pack with blisters defining the chamber formations.

20. The package of claim 16, wherein the majority of each supporting blister remains within the box or sleeve when the container is in the fully extended position.

21. The package of claim 11, wherein the container and the tab member are belt-driven.

22. The package of claim 11 wherein the container and the tab member are attached to a belt of the box or sleeve such that pulling the tab member out of one end of the box or sleeve causes the container to move out of the other end of the box or sleeve.

23. The package of claim 11 wherein the container or tab member comprises an aperture for the insertion of a fingertip of a user.

24. A belt driven package comprising a box or sleeve, a tab member, a belt, and a container suitable for withdrawal from a first end of the box or sleeve in a first direction to a fully extended position whereby a user can remove any item or items stored by the container, the belt extending between a first end and a second end of a belt path, wherein the tab member and the container are attached to the belt such that the container is driven by the belt to move out of the first end of the box or sleeve when the tab member is moved out of an opposed second end of the box or sleeve;

the container comprising a base carrying one or more chamber formations for containing items to be removed by the user;

the package being arranged such that an end portion of the base is retained substantially within the box or sleeve when in the fully extended position;

the base having at least one stabilising formation on the end portion that interacts with the box or sleeve when in the fully extended position to resist pivoting of the container relative to the box or sleeve; and the or each stabilising formation having a length in the first direction that is greater than or equal to its width in a second direction, the second direction being substantially orthogonal to the first direction across the base;

the container having opposed first and second ends, and the second end of the container having a cut-out portion, the cut-out lying between opposed blisters or other stabilising formations at that end of the container; and the package having a closed position in which the container and tab member are both housed substantially within the sleeve, with the container overlying the tab member wherein:

when the package is in the closed position, the cut-out portion of the container defines a pull region of the tab member, the pull region enabling a user to grasp the tab member without grasping the container.

25. The package of claim 24 wherein the tab member is a second container carrying one or more chamber formations for containing items to be removed by a user.

26. The package of claim 24 wherein the tab member is substantially flat.

27. The package of claim 24 wherein the tab member printed with information concerning the items within the blister pack.

28. The package of claim 24 wherein an information leaflet is attached to the tab member.

29. The package of claim 24, wherein the cut-out of the container is located substantially centrally with respect to the width of the associated end of the container, the stabilising formations of its container comprising first and second supporting blisters spaced apart from each other towards corners of that end.

30. The package of claim 24, wherein the size and orientation of the stabilising formations of the container is chosen so that they interact with the box or sleeve to stabilise the container when fully extended from the sleeve in a position in which a major portion of the container extends from the box or sleeve, and a minor portion of the container is retained substantially within the box or sleeve.

31. The package of claim 24, wherein each stabilising formation of the container differs in size and/or shape to the or each chamber formation of the container; and each stabilising formation has a length in the first direction that is greater than or equal to its width in a second direction, the first direction corresponding to a direction of withdrawal of the associated container from the box or sleeve, and the second direction being substantially orthogonal to the first direction across the base.

32. The package of claim 24, wherein the container takes the form of a blister pack with blisters defining the chamber formations.

33. The package of claim 29, wherein the majority of each supporting blister remains within the box or sleeve when the container is in the fully extended position.

34. The package of claim 24 wherein the container or tab member comprises an aperture for the insertion of a fingertip of a user.

35. The package of claim 10, wherein the container is opposed to a substantially flat tab member housed within the box or sleeve.

36. The package of claim 10, wherein the container is opposed to a second container comprising a blister pack housed within the box or sleeve.

* * * * *